United States Patent [19]

Schneider

[11] Patent Number: 4,949,876

[45] Date of Patent: Aug. 21, 1990

[54] DISTRIBUTOR FOR A PASTY MATERIAL COMPRISING AN AXIAL PUSHBUTTON MEMBER WITH LATERAL DISTRIBUTION AND AN ELEMENT FOR MASKING ITS OUTLET ORIFICE

[75] Inventor: Bernard Schneider, Sainte Menehould, France

[73] Assignee: Cebal, Clichy, France

[21] Appl. No.: 311,771

[22] Filed: Feb. 17, 1989

[30] Foreign Application Priority Data

Feb. 19, 1988 [FR] France ..... 88 02507

[51] Int. Cl.[5] ..... B67D 5/40

[52] U.S. Cl. ..... 222/209; 222/379; 222/383; 222/514; 222/522

[58] Field of Search ..... 222/207, 209, 372, 379, 222/383, 514, 522, 523, 531, 537

[56] References Cited

U.S. PATENT DOCUMENTS

| | | | |
|---|---|---|---|
| 3,680,738 | 8/1972 | Vos . | |
| 3,884,390 | 5/1975 | Hazard | 222/522 |
| 4,671,428 | 6/1987 | Spatz | 222/209 |
| 4,685,594 | 8/1987 | Czeck | 222/383 |
| 4,779,774 | 10/1988 | Morel | 222/522 |
| 4,807,784 | 2/1989 | Jupin et al. | 222/383 |
| 4,821,926 | 4/1989 | Battegazzore | 222/209 |
| 4,830,228 | 5/1989 | Fillmore | 222/209 |

FOREIGN PATENT DOCUMENTS

| | | | |
|---|---|---|---|
| 213048 | 3/1987 | European Pat. Off. . | |
| 3122330 | 1/1983 | Fed. Rep. of Germany . | |
| 3512649 | 10/1986 | Fed. Rep. of Germany | 222/207 |
| 2561230 | 9/1985 | France . | |
| 2581370 | 11/1986 | France . | |

*Primary Examiner*—H. Grant Skaggs
*Assistant Examiner*—Steven M. Reiss
*Attorney, Agent, or Firm*—Dennison, Meserole, Pollack & Scheiner

[57] ABSTRACT

The invention concerns a distributor for pasty material. A pushbutton member (101) is provided with a distribution conduit (105) having a lateral outlet. The pushbutton member being slidable longitudinally with respect to a guide means (110) which is fixed with respect to the body of the distributor. The distribution conduit being sealingly connected to an element for carrying the flow of pasty material to the conduit (105). The pushbutton member (101) acting on a spring-action element causing it to be returned to the released position, and on a compression element forming part of the element for carrying the flow of pasty material. The distributor is characterised in that it includes a masking element (113) which is fixed with respect to the body of the distributor (116). The element leaving the outlet orifice (116) of the distribution conduit (105) open when the pushbutton member (101) is depressed and masking the orifice (116) when the pushbutton member (101) is released. The invention is used for distribution operations in the fields of cosmetology, hygiene and health, pharmaceuticals and foodstuffs.

11 Claims, 3 Drawing Sheets

FIG. 6
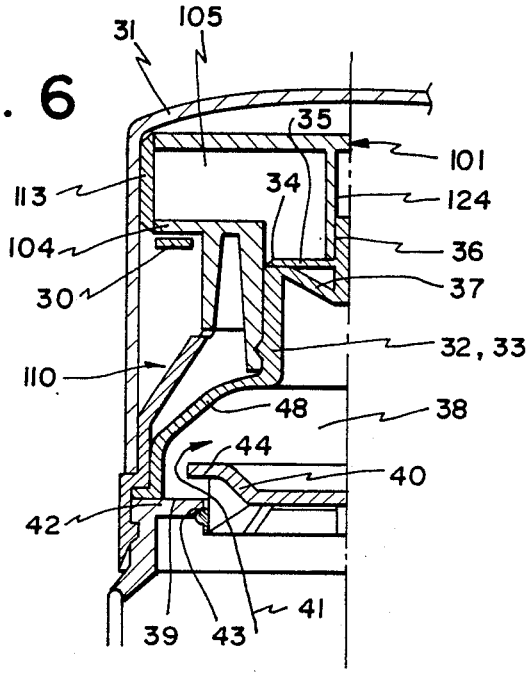
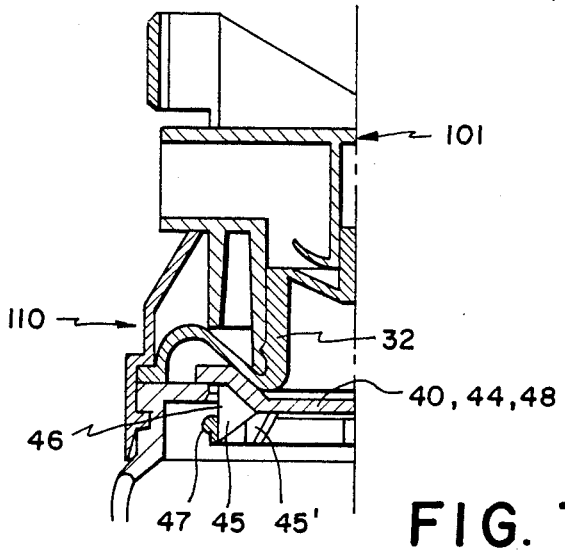
FIG. 7

DISTRIBUTOR FOR A PASTY MATERIAL COMPRISING AN AXIAL PUSHBUTTON MEMBER WITH LATERAL DISTRIBUTION AND AN ELEMENT FOR MASKING ITS OUTLET ORIFICE

BACKGROUND OF THE INVENTION

The invention concerns a distributor for pasty material, comprising a pushbutton member with lateral distribution, the pushbutton member sliding with a rectilinear movement with respect to one or more guide means which are fixed with respect to the body of the distributor.

DE-A-3 122 330 describes a distributor of that type wherein the pushbutton member is provided with a distribution conduit having a lateral outlet, the pushbutton member being slidable axially with respect to a fixed part of the distributor and acting by virtue of the depression movement thereof on a return spring and on means for carrying the flow of pasty material. The external tubular skirt of the head of the distributor carries in its upper part an inclined portion which serves as a sealing abutment for the outlet orifice of the distribution conduit of the pushbutton member when the latter is released.

That inclined portion then masks the outlet orifice but it suffers from the disadvantage of not removing the residues of pasty material which may adhere to the distribution conduit in the vicinity of its orifice and which can then be troublesome, either because they subsequently prevent the disttributor from producing strands of pasty material which are of a regular shape, or because they result in an unattractive appearance, or because they prevent the cap from being easily fitted into place again or make it excessive messy.

The applicants sought to develop an improved distributor which does not suffer from those disadvantages.

SUMMARY OF THE INVENTION

The invention concerns a distributor for a product which, as is known from DE-A-3 122 330, comprises a pushbutton member provided with a distribution conduit having a lateral outlet, the pushbutton member being longitudinally slidable with respect to a fixed part of the distributor and acting on a spring-action return means and on the means for passing the flow of pasty material, said distributor comprising an element for masking the outlet orifice of said distribution conduit in the released position of the pushbutton member, the masking element being carried by an external tubular part of the distributor and leaving said orifice open when said pushbutton member is depressed.

In accordance with the invention the pushbutton member is slidable with respect to said external tubular part of the distributor and the end surface surrounding said outlet orifice and the surface of the masking element which is disposed facing said end surface when the pushbutton member is released are both parallel to the direction of sliding movement of the pushbutton member, the masking element then cutting the end of the strand of pasty material and scraping said end surface of the distribution conduit when the pushbutton member is released.

The construction is simpler than that of DE-A-3 122 330 and there cannot be any accumulation of residues of pasty material, which can interfere with operation of the distributor.

The pushbutton member preferably comprises a central portion having a contact wall portion and a sliding external side wall and an outlet portion of the distribution conduit which projects laterally beyond said sliding portion, said sliding side wall of the pushbutton member sliding within the external tubular part of the distributor. By virtue of the parallel relationship of the end surface around the outlet orifice and the surface of the corresponding portion of the masking element, with the direction of sliding movement of the pushbutton member, releasing the pushbutton member results in a masking action by virtue of a shearing movement, permitting the end of the strand of pasty material to be cut off and providing for scraping of the periphery of the orifice. It can be noted that, when said mutually parallel surfaces are at a small angle which in practice is less than 10° to the direction of sliding movement, that still produces the effect of cutting off the flow of pasty material, depending on the viscosity thereof.

The position of the masking element which is part of said external tubular part as well as the geometry of the pushbutton member and more precisely the position of the end of its distribution conduit and the clamping thereof by said external side wall or sliding wall are preferably such that the masking element is at +0 to +0.4 mm from the end surface of the distribution conduit and preferably at less than +0.3 mm from said surface so as to provide good protection for the distribution orifice as well as an effective scraping action in regard to the end surface of the conduit.

In order to improve the effect of cutting the strand or pasty material, which is produced by the masking element, it is preferable to have a reduction in the thickness of the active edge of said element by means of an external chamfer, said active edge being that which first encounters the strand of pasty material once the pushbutton member is released.

The upper edge or free edge of the external tubular part in which the pushbutton member is slidable advantageously defines at least one level of support in respect of the outlet portion which projects laterally beyond the pushbutton member, thus regulating the metering effect in respect of the pasty material.

The external tubular part can also form an element for guiding the pushbutton member upon depression thereof and for providing for more complete protection for its lateral outlet portion. It thus preferably comprises an opening, the longitudinal edges of which limit the lateral or rotational movements of the pushbutton member and the lower edge of which limits the depression movement of the pushbutton member, and also a masking element in the form of a band which is connected to the edges of the opening by side wall portions, and possibly topped by a protective wall portion, the cap-shaped masking element protecting the outlet portion of the distribution conduit when the pushbutton member is released.

The distributor of the invention preferably comprises, with its external tubular part for guiding the pushbutton member, said tubular part in most cases carrying the masking element, the following means for carrying the flow of the pasty material and for the return movement of the pushbutton member:

- a deformable tubular cup which is sealingly fixed to the body of the distributor and to the pushbutton member, said cup delimiting a compression chamber and forming both the spring-action element and the compression means on which the pushbutton member acts by virtue of the depression movement thereof, and returning the pushbutton member to the released position thereof;

preferably with said deformable cup, a longitudinal sleeve carried by the underside of the contact wall portion of the pushbutton member, to which an outlet tube of said deformable tubular cup is sealingly fixed, a part of said sleeve constituting the beginning of the distribution conduit;

the end of said outlet tube of the deformable tubular cup preferably and in a particularly advantageous manner forming with the underside of the contact wall portion of the pushbutton member the valve for expulsion of the pasty material from the compression chamber towards said distribution conduit of the pushbutton member.

Two remarkable structures for expulsion valves of that type are described in the specific description.

The position of the masking element of the invention can be sufficiently set back that it does not prevent or impede the fitting of a cap provided for presentation and cleanliness purposes; for example it may correspond to the diameter of the portion of the external tubular part around which the end of the skirt of the cap fits.

Finally when the masking element is in the form of a bend connected to the external tubular part by side wall portions, the outlet portion of the distribution conduit of the pushbutton member, in the rest condition, being engaged into the U-shaped band, the distributor is advantageously made theft-proof by means of a plate portion connected by breakable bridges to the bottoms of the side wall portions of the band, said plate portion which is produced by moulding of said external tubular part preventing the pushbutton member from being depressed in an improper fashion and thus clearly indicating first use of the distributor.

The following examples will illustrate embodiments and certain advantageous particularities of the distributor of the invention.

BRIEF DESCRIPTION OF THE DRAWINGS

FIG. 6 is a view in axial section through the axis of the distribution conduit of half of the top of the second distributor according to the invention, prior to use thereof, and FIG. 7 is a view in axial section in the same way showing the top of the same distributor, with the pushbutton member being depressed.

DESCRIPTION OF THE INVENTION

Figure 1:
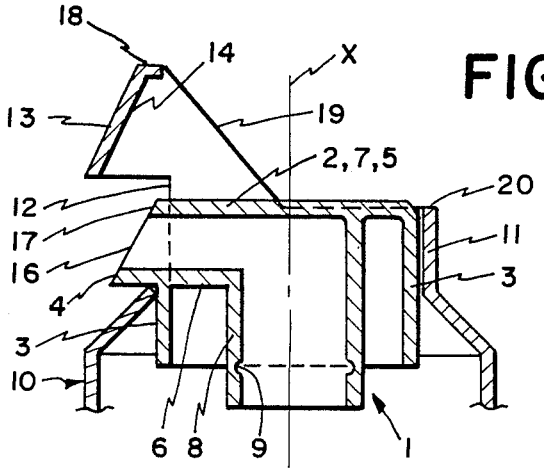
FIG. 1 shows the pushbutton member and the tubular guide piece of a first preliminary test distributor, with the pushbutton member being in the depressed condition, in axial section through the axis of the distribution conduit.

The pushbutton member 1 in FIG. 1 comprises an upper wall portion 2 serving as a contact or bearing means and a circular cylindrical side wall 3 which is interrupted by the substantially radial emergence of the outlet portion 4 of the conduit 5 for distribution of the pasty material. The conduit 5 is of an ovalised cross-section which is flattened on its lower and upper walls 6 and 7 which in their central parts are perpendicular to the axis X of symmetry corresponding to the direction of sliding movement of the pushbutton member 1. In the part of the conduit 5 which is within the side wall 3, its upper wall 7 is merged with the upper wall portion 2 of the pushbutton member 1. The conduit 5 opens into a circular cylindrical central sleeve 8 which upon assembly is sealingly fixed by the groove 9 on a deformable tubular cup of the type shown in FIG. 5 or of the type shown in FIGS. 6 and 7.

The guide means associated with the pushbutton member 1 is an external tubular part 10 having the same axis X as the pushbutton member 1, the upper portion 11 of the part 10 being of a circular cylindrical configuration and having a diametral play of 0.2 mm with respect to the side wall 3 of the pushbuttton member 1 which is slidable in said part 10. At the location at which the outlet portion 4 emerges from the pushbutton member 1 the upper portion 11 comprises an opening 12 for the outlet portion 4 to pass therethrough, topped by a fixed masking element 13 in the form of a peak or visor, the internal surface 14 of which is applied against the orifice 16 and against its periphery 17 in the released position of the pushbutton member. The above-mentioned internal surface 14 and the surface of the periphery 17 of the orifice 16 are slightly curved, are parallel to each other and are inclined at about 25° with respect to the axis X.

In its upper part the masking element 13 has a small horizontal rim portion 18 which completes the protection for the end of the conduit 5 in the released position of the pushbutton member 1 and stops the upward movement of the pushbutton member 1 about 1 mm before it has moved completely to the top, so that in the rest condition the end 16 and 17 of the conduit 5 is applied resiliently against the masking element 13, thus providing a sealing closure effect. The upper edge of the masking element 13 is connected by two inclined edges 19 to the upper end edge 20 of the rear part of the sliding portion 11. The edge 20 is perpendicular to the axis X and is 0.5 to 1 mm below the wall portion 2 of the pushbutton 1 when the latter is depressed so that the guiding action for the pushbutton member 1 is still good in that position. The closure effect which is produced here by virtue of simple resilient contact is a particularly attractive proposition in relation to pasty materials of fairly low or medium viscosity, which involve the pasty material clinging to components of the arrangement to a limited extent.

Figure 2:
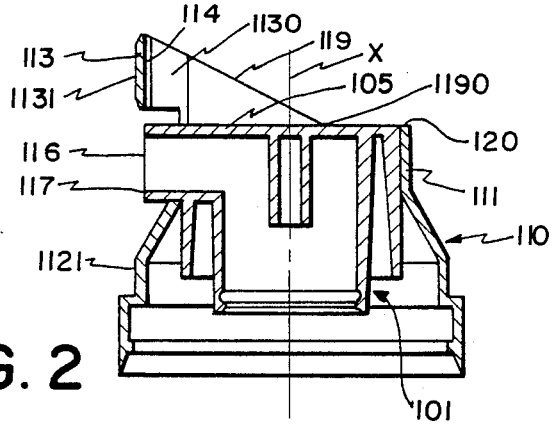
FIG. 2 shows the pushbutton member and the tubular guide piece of a second distributor according to the invention, with the pushbutton member being in the depressed condition, in section in the same manner.
Figure 3:
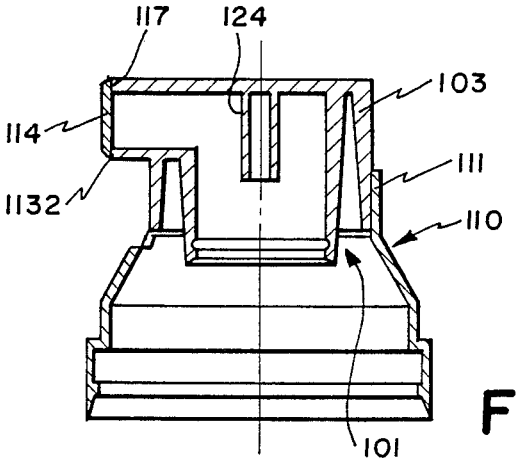
FIG. 3 is a view in the same section of the same components in FIG. 2, in the released position of the pushbutton member.

The distributor shown in FIGS. 2 and 3 involves a substantial modification with respect to the first distributor: the periphery 117 of the orifice 116 of the conduit 105 in the pushbutton member 101 and the internal surface 114 of the masking element 113 are both parallel to the direction of sliding movement X of the pushbutton member 101. By comparing FIG. 2 (with the pushbutton member 101 in the depressed condition) and FIG. 3 (released position of the pushbutton member), it can be seen that, when the pushbutton member 101 which is subjected to the expansion effect of a spring-action element which it compressed by virtue of being depressed, moves back up again, its end surface 116 and 177 is displaced with a shearing movement with respect to the surface 114 of the masking element. The pushbutton member 101, and the external tubular guide part 110 are both of moulded polypropylene with thicknesses of from 1 to 1.2 mm for the components which perform a function in regard to positioning, and are of the following dimensions in the cross-sectional plane:

- circular cylindrical internal diamter of the upper sliding portion 110 of the guide part 110=22.2 mm
- external diameter of the circular cylindrical side wall 103 of the pushbutton member 101=22.1 mm
- overall dimension of the pushbutton member 101 in the cross-sectional plane=25.9 mm
- distance between the prolongations of the internal surfaced 114 of the masking element 113 and the sliding portion 111 which is opposite thereto, in the direction of the axis of the distribution conduit 105=26.0 mm.

It was found that, the internal elements related to the movement of the pushbutton member being shown in FIGS. 6 and 7, that arrangement produced a very good shearing effect for the ends of a strand of pasty material which is fairly viscous, and a scraping action in respect of the orifice 116 and its periphery 117, thus making it possible to overcome the disadvantages involved in drying and hardening of the pasty residues which come from the orifice 116 or adhere to the periphery 117 thereof.

To achieve such results, the following conditions are typically observed: diametral clearance in respect of sliding movement of the pushbutton member 101 in the sliding portion 111 of the guide part 110=0.2 mm maximum; and clearance between the pushbutton member 101 and the guide part 110 at the location of the end 117 of the distribution conduit 105 and the masking element 113=less than 0.3 mm.

The lower edge of the masking element 113 is reduced in thickness by virtue of an external chamfer 1132, which generally improves the shearing effect in respect of the ends of a strand of fairly viscous pasty material.

Figure 4:
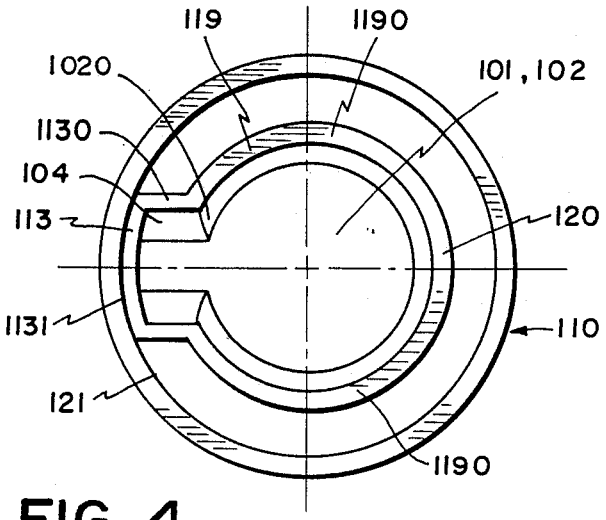
FIG. 4 is a plan view of the same components.

FIG. 4 (plan view) shows that the upper wall portion 102 of the pushbutton member 101 comprises slight rounded chamfers as indicated at 1020. The pushbutton member 101 is engaged with small clearance into the external tubular part 110, with a clearance of 0.1 mm in respect of diameter for the circular cylindrical zones and, in the released position of the pushbutton member, 0.3 to 0.4 mm between the outlet portion 104 and the side wall portions 1130 of the masking element 113 Beyond the side wall portions 1130 the upper edge of the external part 110 is continued by two inclined edges 119 (see FIGS. 2 and 4) which a little beyond the half-circumference position meet its rearward part 120 which is perpendicular to the axis of sliding movement X, thus giving a good compromise between the aspect of ease with which the user of the distributor can press against the pushbuttom member 101 and the degree of rigidity in regard to guiding it when it moves back up again. More precisely in this case the rearward upper edge 120 extends over an angle of 140° between the connecting points 1190 and in practice it is desirable for that angular extent to remain between 100° and 160°. The external front surface 1131 of the masking element 113 overhangs the circular cylindrical part 121 around which the protective cap (see FIG. 6) is to fit, it is in line with or slightly set back with respect to that cylindrical surface 121 in order not to interfere with fitting of the cap.

Figure 5:
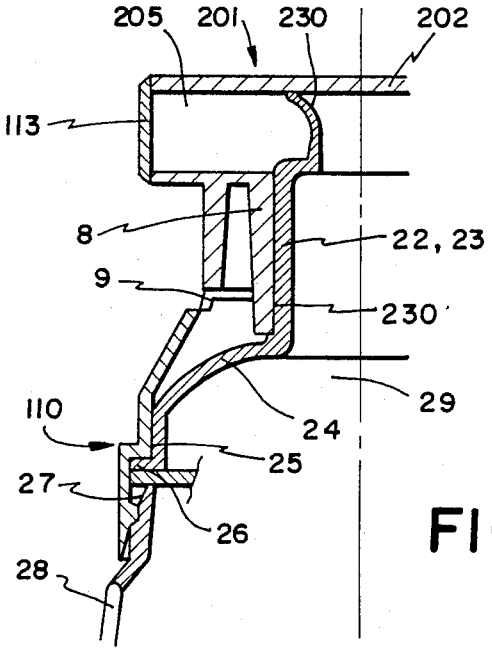
FIG. 5 is a view in axial section through the axis of the distribution conduit of half of the top of a third distributor according to the invention, with the pushbutton member being in the released condition.

FIG. 5 shows the top of a third distributor provided with a deformable tubular cup 22 of polyester-ether and fixed in the central sleeve 8 of the pushbutton member 201 by its upper tubular portion 23, the external rib 230 of which is engaged into the internal groove 9 in the bottom of the sleeve 8.

The third distributor has the same tubular guide portion 110 as the second distributor and the pushbutton member 201 is identical to the pushbutton member 101 except for the end of the sleeve 8 which is smooth whereas in the case of the second distributor it comprises a small axial tube portion 124 (see FIG. 3 for example). The upper tubular portion 23 of its deformable cup 22 terminates with a thin flexible flared lip 230 which is 0.2 mm in thickness at its end and which resiliently bears sealingly against the end of the sleeve 8, that is to say against the underneath surface of the wall portion 202. The deformable cup 22, below the upper tubular portion 23, comprises a deformable wall portion 24 in the form of a dome of reduced thickness of 0.9 mm, and then a lower semi-rigid tubular portion 25 and a lower rim portion 26 for fixing it between the bottom of the guide portion 100 and the top 27 of the tubular body 28 of the distributor. The deformable cup 22 delimits a compression chamber 29, the intake valve of which is not shown in FIG. 5 but is identical to that of the second distributor (FIGS. 6 and 7), and in respect of which the valve for expulsion of the pasty material into the distribution conduit 205 is formed by the resilient lip 230 and by the top of the wall portion 202 which is also the wall of the conduit 205. That arrangement provides that the pushbutton member 201 is guided and moved upwardly again in a particularly reliable manner, thus providing for good reproducibility of the effects of the masking element 113: shearing of strands of fairly viscous pasty material, scraping the end orifice of the distribution conduit 205 and the periphery thereof, and closing off that orifice with a small clearance.

FIGS. 6 and 7 show the top of the second distributor respectively prior to first use thereof and in use thereof, with the pushbutton member 101 then being depressed. For storage and sale, the masking element 113 which does not have an upper rim portion so as to permit the pushbutton member 101 to be introduced by way of the top of the tubular guide element 110 upon assembly of the distributor is provided in its lower part, below the outlet portion 104 of the distribution conduit 105 of the pushbutton member 101 in the released condition, with a plate portion 30 which is connected to the bottoms of the side wall portions as indicated at 1130 (FIG. 4) by breakable bridges. A protective and presentation cap 31 is in place, without being impeded by the masking element 113, as referred to in relation of FIG. 4. After the cap 31 has been removed, it will only be necessary to depress the pushbutton 101 by from 1.5 to 2 mm to cause the breakable bridges to be broken and to cause the theft-proofing plate portion 30 to drop down, whereas the maximum depression movement of the pushbutton member 101 (in the position shown in FIG. 7) is over a distance of 9 mm.

The pushbutton member 101 is fixed on a deformable tubular cup 32, in which only the upper end of the upper tubular portion 33 differs from the upper end 230 of the upper tubular portion 23 of the cup 22 in the second distributor. The upper end 33 comprises an annular end edge 34 and a flexible disc 35 whose periphery is held in contact against the edge 34 by virtue of the axial tubular portion 124 bearing thereagainst, the disc 35 carrying an axial centering stem 36 which engages into the axial tubular portion 124, thus providing for good centering of the flexible element 35 which with the annular edge 34 forms the expulsion valve 34 and 35 of the distributor.

In addition, and this is advantageous is regard to the assembly operation, the underneath of the flexible disc 35 is connected to the interior of the upper tubular portion 33 by three flexible legs 37 which are spaced at 120°, with a cross-sectional dimension of 1×0.6 mm. Outside its central zone the thickness of the flexible disc is 0.3 mm. In itself, the expulsion valve 34 and 35 which in this embodiment is in one piece with the remainder of the deformable tubular cup 32, permits pasty material to pass therethrough more easily than the valve shown in FIG. 4, and a more rapid upward return movement of the pushbutton member 101, thus improving the cutting and scraping action of the masking element 113. Results will be set out hereinafter.

The second distributor, like the third distributor, comprises (see FIGS. 6 and 7), at the base of the compression chamber 38 defined by the deformable cup 32, a valve 39 and 40 for intake of the pasty material contained in the storage chamber above a sliding bottom piston (not shown), into the compression chamber 38, the pasty material being passed into the compression chamber 38 in this case in the substantially radial directions indicated by the arrow 41 in FIG. 6. The top of the tubular body comprises a transverse partition 42 separating the storage chamber from the compression chamber 38, and the partition 42 comprises a flow orifice 43 of a diameter of 22 mm surrounded by an annular surface 39 forming the seat for the intake valve 39 and 40, the valve member 40 of the valve arrangement comprising a projecting upper wall portion 44, the annular edge of which is sealingly applied against the annular surface 39 in the valve-closed position (FIG. 7), and a subjacent portion provided in its lower part with one or more raised retaining portions of an overall diameter which is 0.4 to 2 mm larger than the diameter of the flow orifice 43, said overall diameter permitting the valve member 40 to be fitted by snap engagement through said orifice.

In the present case the subjacent portion comprises twelve radial spaced raised portions as indicated at 45 and 45', whose longitudinal edges as indicated at 46, of an overall diamter of 21 mm, serve as means for guiding the valve member 40 in the orifice 43, as well as a retaining limb portion 47 of circular contour supported by the portions 45. The closure wall portion 44 of the valve member 40 comprises a recessed central zone 48, the underneath of the zone 48 being at a height which is intermediate the flow openings for the pasty material which are defined by the annular edge of the wall portion 44, the raised portions as indicated at 45 and 45' and the circular portion 47, which facilitates flow of the pasty material through the valve member 40, while permitting more pronounced squashing of the pumping element 32 (see FIG. 7). The axial travel movement of the valve member 40 in the orifice 43 is 3 mm.

In the course of tests which were carried out, it was found that the arrangement of the expulsion valve 34 and 35 of the second distributor was markedly better than that of the expulsion valve 230 and 202 of the third distributor, the expulsion force as indicated by the force required on the pushbutton member to cause distribution of the pasty material going from more than 4 kg to about 2.5 kg while the energy available for cutting the pasty material or scraping away the pasty material residue was greater. It was also found that the arrangement of the valve member 40 which facilitates the flow of pasty material while reducing the intake energy made it possible to retain a short time for the pushbutton member to move back up again when the thickness of the deformable wall portion 48 of the deformable tubular cup 32 was reduced in such a way as further to reduce the force that had to be applied to the pushbutton member 101. The combination of the two arrangements is thus particularly advantageous, in particular in regard to good use of the masking element of the invention in its functions of scraping away and cutting off the ends or residue of the pasty material.

The deformable tubular cup is preferably made of one of the materials of the group consisting of: thermoplastic polymers, silicone resins and rubbers. The intake valve which is typically of medium or high density PE or of PP is advantageously made in one piece and at the same time as the top of the tubular body, which is the case here, with the lower part of its subjacent portion 44 below its raised retaining portions 45 being connected to the edge of the flow opening 43 by a breakable peripheral film, breaking of that connection and snap engagement of the raised portions 45 then taking place in the same pushing operation.

The invention can be used in relation to distributors for pasty materials or creams in the fields of cosmetology, hygiene and health, pharmaceuticals and foodstuffs.

I claim:

1. A distributor for pasty material comprising a pushbutton member (101; 201) provided with a distribution conduit (105; 205) with a lateral outlet, the pushbutton member (101; 201) being longitudinally slidable with respect to a fixed part (110) of said distributor and acting on a spring-action return means (22; 32) and on the means (22, 230 and 202; 32, 34 and 35) for passing the flow of pasty material, said distributor comprising an outlet orifice (116), a masking element (113) with a surface (114) and an end surface (117) for masking the outlet orifice (116) of said distribution conduit (105; 205) in the released position of the pushbutton member (101; 201), said masking element (113) being carried by an external tubular part (110) of the distributor and leaving said orifice (116) open when said pushbutton member (101; 201) is depressed, characterised in that said pushbutton member (101; 201) is slidable with respect to said external tubular part (110) of the distributor, said end surface (117) surrounding said outlet orifice (116) of said conduit (105; 205) and the surface (114) of the masking element (113) which is disposed facing said end surface (117) when the pushbutton member (101; 201) is released both being parallel to the direction of sliding movement (X) of the pushbutton member, the masking element (113) then cutting the end of the strand of pasty material and scraping said outlet orifice (117) and said end surface (116) of the distribution conduit (105; 205) when the pushbutton member (101; 201) is released; and said means (22, 230 and 202, 32, 34 and 35, 39 and 40) for passing the flow of the pasty material comprise a deformable tubular cup (22, 32) sealingly fixed to the body of the distributor and to the pushbutton member (101, 201), said cup (22, 32) delimiting a compression chamber (29, 38) and forming both the spring-action element and the compression means on which the pushbutton member (101, 201) acts by virtue of the depression movement thereof, and returning the pushbutton member to the released position.

2. A distributor according to claim 1 characterised in that the underside of the contact wall portion (102; 202) of the pushbutton member (101; 201) carries a longitudinal sleeve (18) to which an outlet tube portion (22, 23) of said deformable tubular cup (22, 32) is sealingly fixed, a part of said sleeve (8) forming the beginning of said distribution conduit (105, 205) of the pushbutton member (101, 201), and the end (230, 34 and 35) of said outlet tube portion (23, 33) of the deformable tubular cup (22, 32) forming with the underside of the contact wall portion (202, 124) of the pushbutton member (201, 101) a valve (230 and 202; 34 and 35) for expulsion of the pasty material into said distribution conduit (105, 205).

3. A distributor according to claim 2 characterised in that said end of said tube portion (33) of the deformable tubular cup comprises an annular end edge (34) and that said expulsion valve (34, 35) comprises a flexible disc (35), the periphery of which is held in contact against said end edge (34) of the tube portion (33) by a means (36) for centrally bearing against said disc (35), which is itself held by the pushbutton member (101), said flexible disc (35) and said end edge (34) of the tube portion (33) respectively forming the valve member (35) and the seat (34) of said expulsion valve (34 and 35).

4. A distributor according to claim 3 wherein said flexible disc (35) and its central bearing means (36) are in one piece with said deformable tubular cup (32), the underside of the flexible disc (35) being connected to the interior of said tube portion (33) of said cup (32) by flexible connecting means (37).

5. A distributor according to claim 1 characterised in that the external tubular part (110) comprises an opening whose longitudinal edges limit the lateral or rotational movements of the pushbutton member (101, 201) and the lower edge of which limits the depression movement (101, 201) of the pushbutton member, said masking element (113) being in the form of a band which is connected to the edges of said opening by side wall portions (1130).

6. A distributor according to claim 5 characterised in that the masking element (113) is provided with a plate portion (30) connected to the bottoms of its side wall portions (1130) by breakable bridges so as to prevent unchecked depression movement of the pushbutton member (101) and clearly to indicate first use of the distributor.

7. A distributor according to claim 1 characterised in that the means (22, 230 and 202; 32, 34 and 35; 39 and 40) for carrying the flow of pasty material also comprise a bottom piston slidable within the body of the distributor and an intake valve (39 and 40) carried by a transverse partition (42) of said body, said partition (42) separating the chamber for storage of the pasty material from said compression chamber (38) comprising an orifice (43) for the pasty material to flow therethrough into the compression chamber (38), the valve member (40) of said intake valve being formed by an upper wall portion (44) of which the annular edge portion sealingly bears against the periphery (39) of said flow orifice (43) in the position of closure of the intake valve (39 and 40) and the subjacent portion (44) of said intake valve which is engaged into said flow orifice (43) being provided in its lower part with one or more raised retaining portions (45, 45') of an overall diameter which is from 0.4 to 2 mm larger than the diameter of said flow orifice (43).

8. A distributor according to claim 7, wherein said intake valve engaged into said flow orifice comprising radial spaced raised portions for guiding said valve member in said flow orifice, said radial portions supporting said one or more raised retaining portions with an overall diameter from 0.4 mm to 2 mm larger than the diameter of said flow orifice, and said radial portions and said one or more retaining portions facilitating the flow of pasty material through said valve member and the squashing of said compression chamber.

9. A distributor according to claim 1 characterised in that the position of said masking element (113), the geometry of the pushbutton member (101; 201) and the gripping thereof by said external tubular part (110) are such that said masking element (113) is at a spacing from the end surface (116 and 117) of the distribution conduit (105, 205), which is between +0 and +0.4 mm.

10. A distributor according to claim 1 characterised in that said portion (104) of the masking element (113) has an edge which is reduced in thickness by an external chamfer (1132), at the side of engagement of said end surface (116 and 117) of the distribution conduit (105, 205) when the pushbutton member (101, 201) is released.

11. A distributor according to claim 1 characterised in that a free edge of said external tubular part (10, 110) defines at least one level of support in respect of the outlet portion (4, 104) of the pushbutton member (1, 101, 201), thus regulating an effect in respect of pasty material.

* * * * *